US007896341B2

(12) United States Patent
Kunieda et al.

(10) Patent No.: US 7,896,341 B2
(45) Date of Patent: Mar. 1, 2011

(54) SHEET CONVEYING DEVICE, SHEET FINISHER, SHEET FEEDING DEVICE, IMAGE FORMING APPARATUS, AND SHEET CONVEYING METHOD

(75) Inventors: Akira Kunieda, Tokyo (JP); Masahiro Tamura, Kanagawa (JP); Makoto Hidaka, Tokyo (JP); Hitoshi Hattori, Tokyo (JP); Junichi Tokita, Kanagawa (JP); Ichiro Ichihashi, Aichi (JP); Nobuyoshi Suzuki, Tokyo (JP); Shuuya Nagasako, Kanagawa (JP); Naohiro Kikkawa, Kanagawa (JP); Kazuhiro Kobayashi, Kanagawa (JP); Tomohiro Furuhashi, Kanagawa (JP); Hiroshi Maeda, Aichi (JP); Tomoichi Nomura, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 326 days.

(21) Appl. No.: 12/073,680

(22) Filed: Mar. 7, 2008

(65) Prior Publication Data

US 2008/0224386 A1 Sep. 18, 2008

(30) Foreign Application Priority Data

Mar. 8, 2007 (JP) ..... 2007-058963
Oct. 26, 2007 (JP) ..... 2007-278922

(51) Int. Cl.
*B65H 38/00* (2006.01)

(52) U.S. Cl. ..... 271/242; 271/270; 270/58.08

(58) Field of Classification Search ..... 271/226, 271/242, 244, 248, 270; 270/18, 58.08
See application file for complete search history.

(56) References Cited

U.S. PATENT DOCUMENTS

| | | | | |
|---|---|---|---|---|
| 4,645,192 | A * | 2/1987 | Watanabe | 271/9.09 |
| 5,119,146 | A * | 6/1992 | Nobumori et al. | 399/396 |
| 5,280,899 | A * | 1/1994 | Kida et al. | 271/10.1 |
| 5,634,635 | A * | 6/1997 | Kobayashi et al. | 271/3.16 |
| 5,775,685 | A * | 7/1998 | Yamaoka et al. | 271/10.13 |
| 5,967,506 | A * | 10/1999 | Miki et al. | 271/10.13 |
| 6,338,481 | B1 * | 1/2002 | Maruchi | 271/188 |
| 6,390,467 | B1 * | 5/2002 | Fukube | 271/256 |
| 6,460,687 | B1 * | 10/2002 | Escobedo et al. | 198/624 |
| 6,505,832 | B2 * | 1/2003 | Moore et al. | 271/265.01 |
| 6,554,216 | B1 * | 4/2003 | Escobedo et al. | 242/270 |
| 6,598,869 | B2 * | 7/2003 | Johnson et al. | 271/3.15 |
| 6,609,708 | B2 * | 8/2003 | Moore et al. | 271/98 |
| 6,729,613 | B2 * | 5/2004 | Marra et al. | 271/10.02 |
| 6,773,009 | B2 * | 8/2004 | So | 271/259 |
| 7,467,793 | B2 * | 12/2008 | Tanabe | 271/245 |
| 7,571,907 | B2 * | 8/2009 | Shinyama | 271/242 |
| 7,637,500 | B2 * | 12/2009 | Schalk et al. | 271/242 |
| 7,651,090 | B2 * | 1/2010 | Satoh et al. | 271/265.02 |
| 2006/0261544 | A1 | 11/2006 | Tamura et al. | |

(Continued)

FOREIGN PATENT DOCUMENTS

JP 2003-072974 3/2003

(Continued)

*Primary Examiner* — Kaitlin S Joerger
(74) *Attorney, Agent, or Firm* — Harness, Dickey & Pierce, P.L.C.

(57) ABSTRACT

A sheet conveying device includes entrance rollers and registration rollers. The entrance rollers convey a sheet received from delivery rollers to the registration rollers. The registration rollers correct skew of the sheet. A conveying path between the delivery rollers and the registration rollers is equal to or slightly longer than a length of a sheet in a maximum allowable size for skew correction in a conveying direction in which the sheet is conveyed on the conveying path.

17 Claims, 12 Drawing Sheets

U.S. PATENT DOCUMENTS

| | | | | |
|---|---|---|---|---|
| 2007/0051219 | A1 | 3/2007 | Tamura et al. | |
| 2007/0138726 | A1 | 6/2007 | Tamura et al. | |
| 2007/0147925 | A1 | 6/2007 | Nomura et al. | |
| 2007/0235917 | A1 | 10/2007 | Nagasako et al. | |
| 2007/0235921 | A1* | 10/2007 | Schalk et al. | 271/242 |
| 2007/0278732 | A1* | 12/2007 | Kitahara | 270/58.08 |
| 2008/0211173 | A1* | 9/2008 | Takahashi et al. | 271/226 |

FOREIGN PATENT DOCUMENTS

| | | |
|---|---|---|
| JP | 2003-212424 | 7/2003 |
| JP | 2005-096931 | 4/2005 |
| JP | 2005-138972 | 6/2005 |
| JP | 2006-137611 | 6/2006 |

* cited by examiner

SHEET CONVEYING DEVICE, SHEET FINISHER, SHEET FEEDING DEVICE, IMAGE FORMING APPARATUS, AND SHEET CONVEYING METHOD

CROSS-REFERENCE TO RELATED APPLICATIONS

The present application claims priority to and incorporates by reference the entire contents of Japanese priority documents 2007-058963 filed in Japan on Mar. 8, 2007 and 2007-278922 filed in Japan on Oct. 26, 2007.

BACKGROUND OF THE INVENTION

1. Field of the Invention

The present invention relates to a sheet conveying device, a sheet finisher, a sheet feeding device, an image forming apparatus, and a sheet conveying method.

2. Description of the Related Art

In recent years, finishers are in widespread use that is capable of correcting the posture or skew of a sheet, detecting and correcting a shift in a direction perpendicular to a sheet-conveying direction, and punching the sheet. Such finishers generally have any or all of functions of, for example, binding, sorting, saddle stitching, and center folding, in addition to punching.

A sheet having an image formed thereon has its leading edge abutting against an entrance roller of the finisher or a registration roller positioned downstream of the entrance roller for skew correction. Then, the position of an end face parallel to a sheet-conveying direction is detected to measure a shift of the sheet. The punching unit is then slid in a shifting direction by the amount of shift for punching. With this operation, accuracy of a punching hole position is improved, thereby improving accuracy of punching-hole alignment for a plurality of sheets.

For example, Japanese Patent Application Laid-open Publication No. 2003-212424 discloses a conventional technology related to such a finisher. In the conventional technology, an entrance roller serves as a registration roller. While a sheet abuts on the entrance roller to be corrected on its posture or skew, a delivery roller of an image forming apparatus that delivers the sheet continues to be driven. Therefore, while the posture of the sheet is corrected, the sheet is deformed (e.g., curls or becomes wavy) between the entrance roller of the finisher and the delivery roller on the image forming apparatus side. Although skew correction is performed with this curl, if a linear velocity of the sheet delivered from the image forming apparatus is increased, larger curl is formed.

That is, the conventional technology can be applied to a low or intermediate-speed image forming apparatus; however, if it is applied to a high-speed image forming apparatus, a sheet is deformed to the extent that it difficult to correct skew with accuracy and to stably convey the sheet.

SUMMARY OF THE INVENTION

It is an object of the present invention to at least partially solve the problems in the conventional technology.

According to an aspect of the present invention, there is provided a sheet conveying device including a correcting unit that corrects skew of a sheet; and a conveying unit that conveys the sheet delivered from a delivering unit to the conveying unit. A conveying path between the delivering unit and the correcting unit is equal to or longer than a length of a sheet in a maximum allowable size for skew correction in a conveying direction in which the sheet is conveyed.

According to another aspect of the present invention, there is provided a sheet conveying method applied to a sheet conveying device including a correcting unit that corrects skew of a sheet and a conveying unit that conveys the sheet delivered from a delivering unit to the conveying unit. The sheet conveying method includes setting a conveying path between the delivering unit and the correcting unit equal to or longer than a length of a sheet in a maximum allowable size for skew correction in a conveying direction in which the sheet is conveyed; causing the sheet to abut on the correcting unit that stops rotating or is rotating reversely; correcting a leading edge position of the sheet which is deformed while abutting on the correcting unit; and allowing the sheet to pass through the correcting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
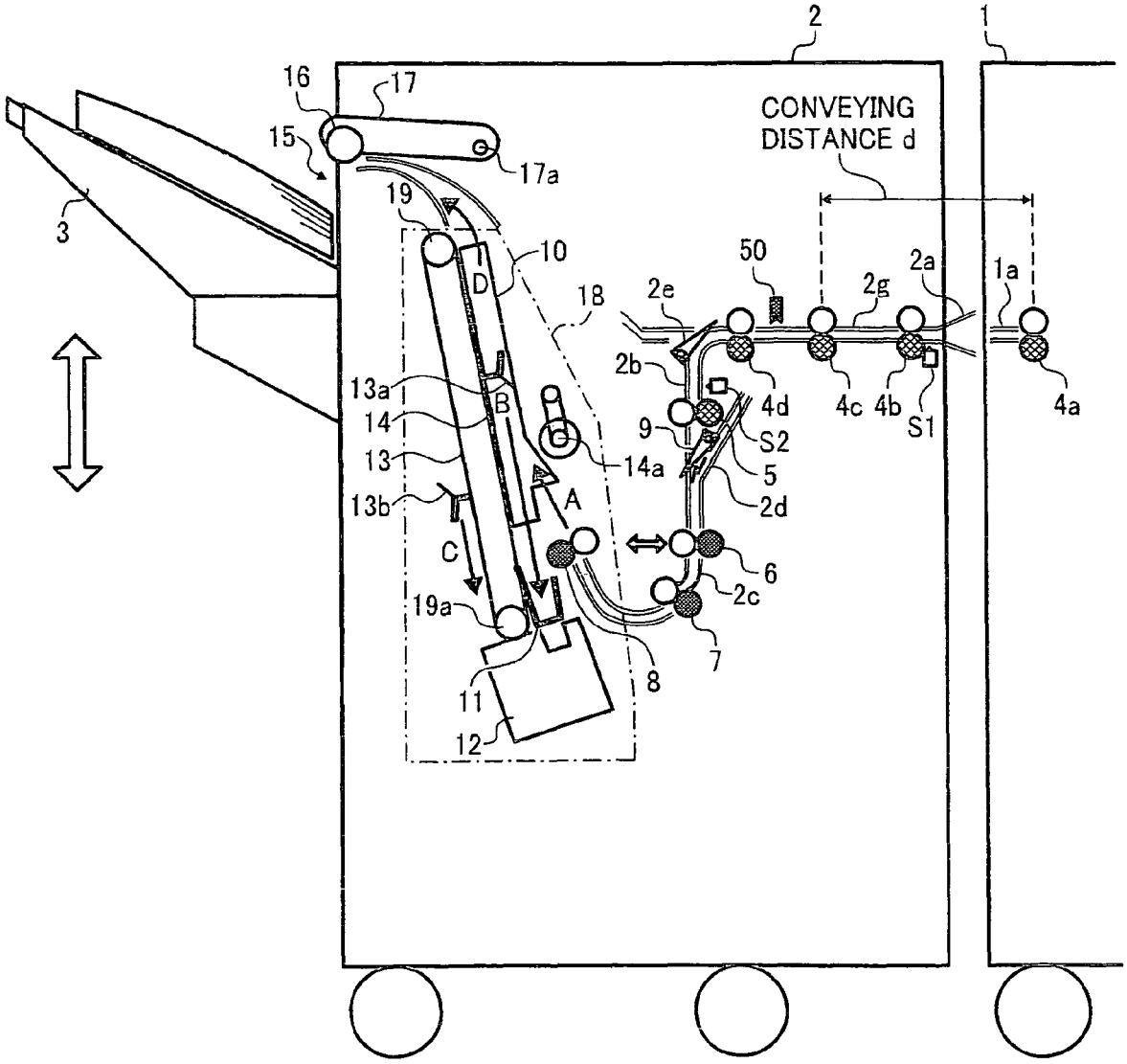
FIG. 1 is a schematic diagram of an image forming system including a sheet finisher and an image forming apparatus according to a first embodiment of the present invention.

FIG. 1 is a schematic diagram of an image forming system according to a first embodiment of the present invention. The image forming system includes an image forming apparatus 1 that forms an image on a sheet, and a sheet finisher 2 that performs post processing, such as alignment and binding, on a sheet delivered from the image forming apparatus 1. The term "sheet" as used herein refers to various types of sheet-type recording medium. The image forming apparatus 1 can be a copier, a printer, a facsimile machine, or a multifunction product (MFP) that combines any or all of functions of these. The sheet finisher 2 can be capable of functions other than alignment and binding such as punching and folding.

The sheet finisher 2 basically includes a receiving inlet 2*a*, lower conveying paths 2*b* and 2*c*, an upper conveyor path, a pre-stack path 2*d*, a sheet processing unit 18, a delivery roller 16, a sheet delivery outlet 15, and a. sheet delivery tray 3. The receiving inlet 2*a* is an opening that receives a sheet from a sheet delivery outlet 1*a* of the image forming apparatus 1. A sheet conveying path 2*g* subsequent to this receiving inlet 2*a* is provided with an entrance sensor S1 and a pair of entrance rollers 4*b*.

The sheet conveying path 2*g* at downstream of the entrance rollers 4*b* is branched into the lower conveying paths 2*b* and 2*c* that guide the sheet to the sheet processing unit 18 side (hereinafter, a path at upstream of a branching point where a switching nail 9 is provided is referred to as "first lower conveying path 2*b*" and a path at downstream thereof is referred to as "second lower conveying path 2*c*") and an upper conveying path that guides the sheet directly to the sheet delivery outlet 15 side (details are not shown in the drawings), and has a branching point disposed with a branching nail 2*e*. This branching nail 2*e* is driven by a stepping motor to switch the sheet conveying path. In place of the stepping motor, a solenoid can be used. On the sheet conveying path 2*g*, a pair of registration rollers 4*c* is provided at a position a conveying distance d away from a nip of the delivery rollers 4*a* provided at upstream of the sheet delivery outlet 1*a* in a sheet-conveying direction. The puncher 50 is disposed at downstream of the registration rollers 4*c* in the sheet-conveying direction, and a pair of conveyor rollers 4*d* are further provided at downstream of the puncher 50. The branching nail 2*e* is located at further downstream of the conveyor rollers 4*d*.

The first lower conveying path 2*b* is provided with a sensor S2 that detects a sheet on the lower conveying path 2*b* from the upstream side in the sheet-conveying direction, and first conveyor rollers 5. The first lower conveying path 2*b* has a lower end branched into the pre-stack path 2*d* at an angle allowing the sheet that goes in reverse to the sheet-conveying direction to be received. At its branching point, the switching nail 9 is provided to function as a guide when the sheet goes in reverse. The second lower conveying path 2*c* is a conveying path from the branching point to the sheet processing unit 18, is provided with second and third pairs of conveyor rollers 6 and 7 and, on the most downstream side, a pair of tray sheet delivery rollers 8 are provided.

The sheet processing unit 18 includes a stapling tray 14 where sheets are delivered and stacked, a first fence 10 that aligns the sheets stacked on the stapling tray 14 in a direction perpendicular to the sheet-conveying direction, a second fence 11 that aligns the sheets in the sheet-conveying direction, a tapping roller 14*a* that puts the sheets delivered onto the stapling tray 14 to the second fence 11 side, the stapler 12 that binds a bundle of sheets aligned on the stapling tray 14, and a discharging mechanism including a discharge belt 13 and a pair of discharge nails 13*a* and 13*b* that discharge the bundle of sheets bounded on the stapling tray 14. The discharge belt 13 is extended and provided between a discharge roller 19 and a driven roller 19*a*, and discharges the bundle of sheets from the sheet delivery outlet 15 onto the sheet delivery tray 3 by any of discharge nails 13*a* and 13*b*. At this time, the bundle of sheets is discharged while pushing the sheet delivery roller 16 provided on a free end side of a sheet delivery lever 17 supported by a supporting shaft 17*a* to be able to swing. With this, a predetermined pressing force is received from the sheet delivery roller 16, thereby allowing the bundle of sheets to be reliably conveyed.

Figure 2:
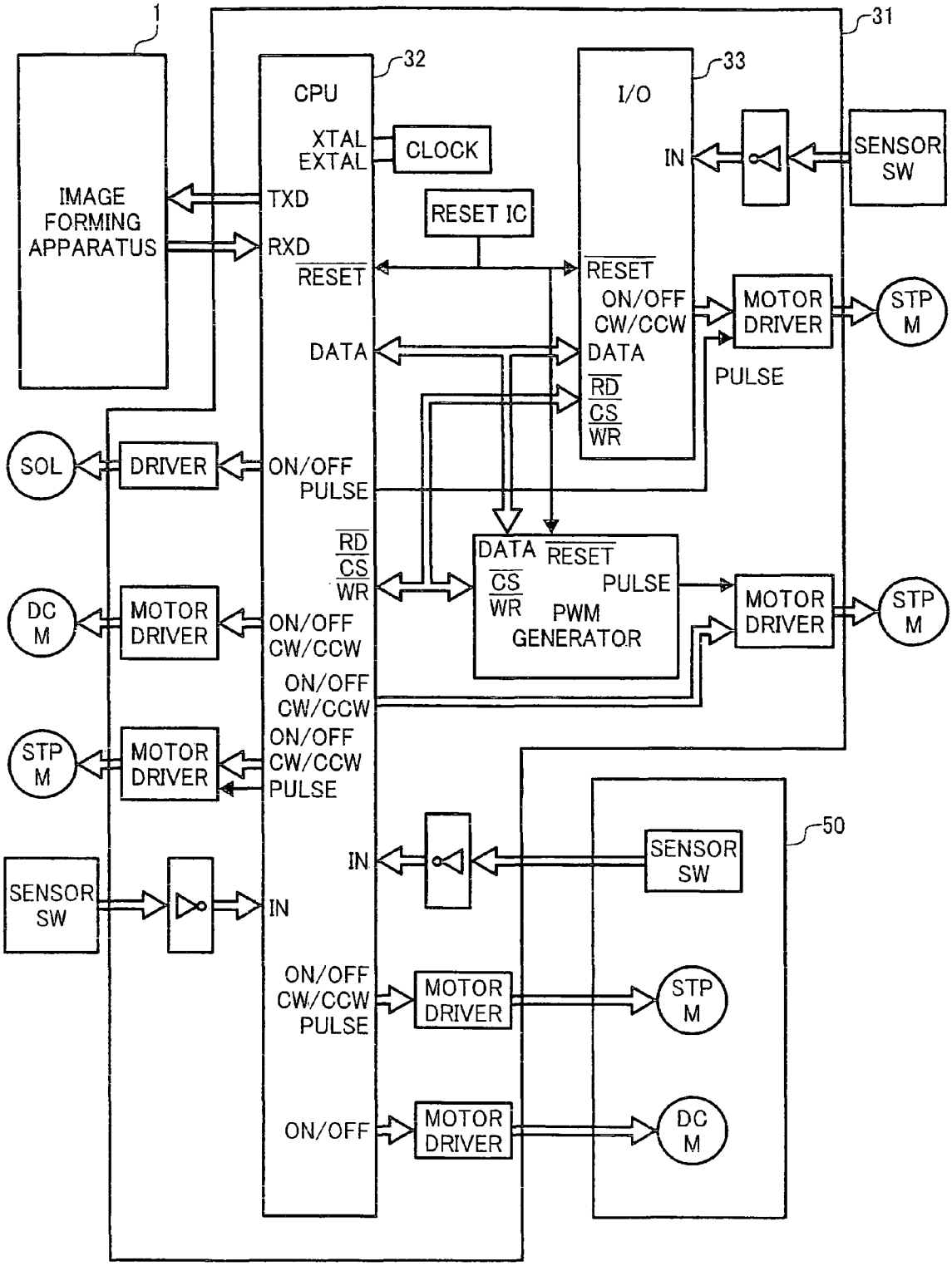
FIG. 2 is a block diagram of a control structure of the image forming system shown in FIG. 1.

FIG. 2 is a block diagram of a control structure of the image forming system. The control device 31 is formed of a microcomputer including a central processing unit (CPU) 32, and an input/output (I/O) interface 33. The CPU 32 receives via the I/O interface 33 signals from switches of a control panel on the image forming apparatus 1, and from sensors (sensor SW) including the entrance sensor S1 and the sensor S2. Based on the signals, the CPU 32 controls motors including stepping motors (STP M) and direct current motors (DC M), solenoids (SOL), and the like. Having been instructed by the CPU 32 to control a stapler driving motor and stapler moving motor (not shown), the stapler 12 drives a staple needle into a predetermined position on the sheet to perform an operation of binding the bundle of sheets.

Here, the control of the sheet finisher 2 is performed by the CPU 32 executing a program written in a read-only memory (ROM) (not shown) by using a random access memory (RAM) (not shown) as a working area. Also, data required for control and processing is stored in an erasable programmable read-only memory (EPROM) 34 in addition to the RAM.

The sheet output from the image forming apparatus 1 enters the sheet finisher 2 from the sheet delivery outlet 1*a* and the receiving inlet 2*a*. The sheet is then detected by the entrance sensor S1, and is conveyed by the entrance rollers 4*b*. When posture or skew of the sheet is corrected, the leading edge of the sheet abuts on the nip of the registration rollers 4*c* and thus the sheet is deformed (e.g., curls or becomes wavy), and then again sheet is started to be conveyed. After passing-through the puncher 50, the sheet is conveyed by the conveyor rollers 4*d*.

Figure 3:
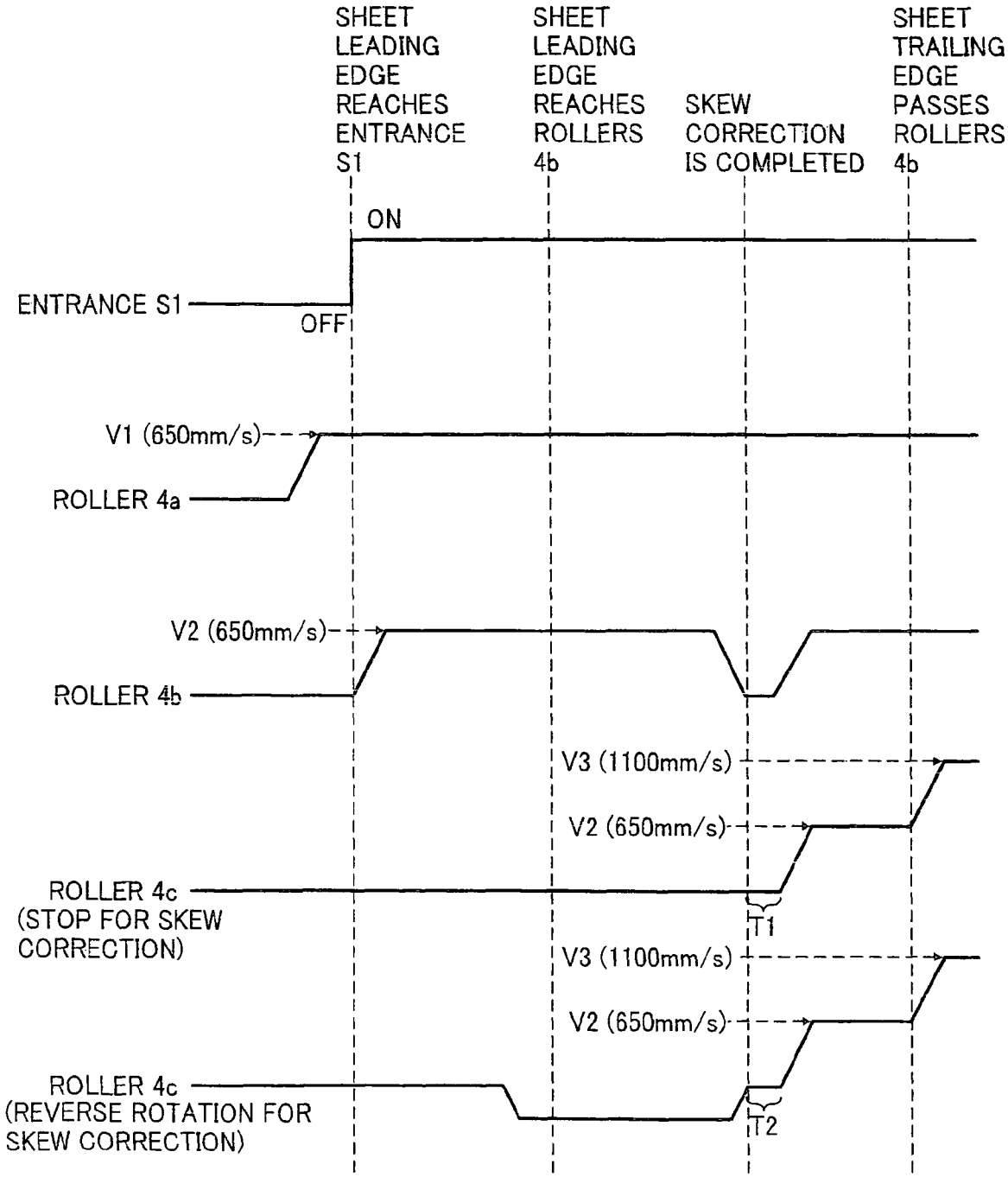
FIG. 3 is a timing chart of the operations of an entrance sensor, delivery rollers, entrance rollers, and registration rollers shown in FIG. 1 to correct sheet posture.
Figure 4:
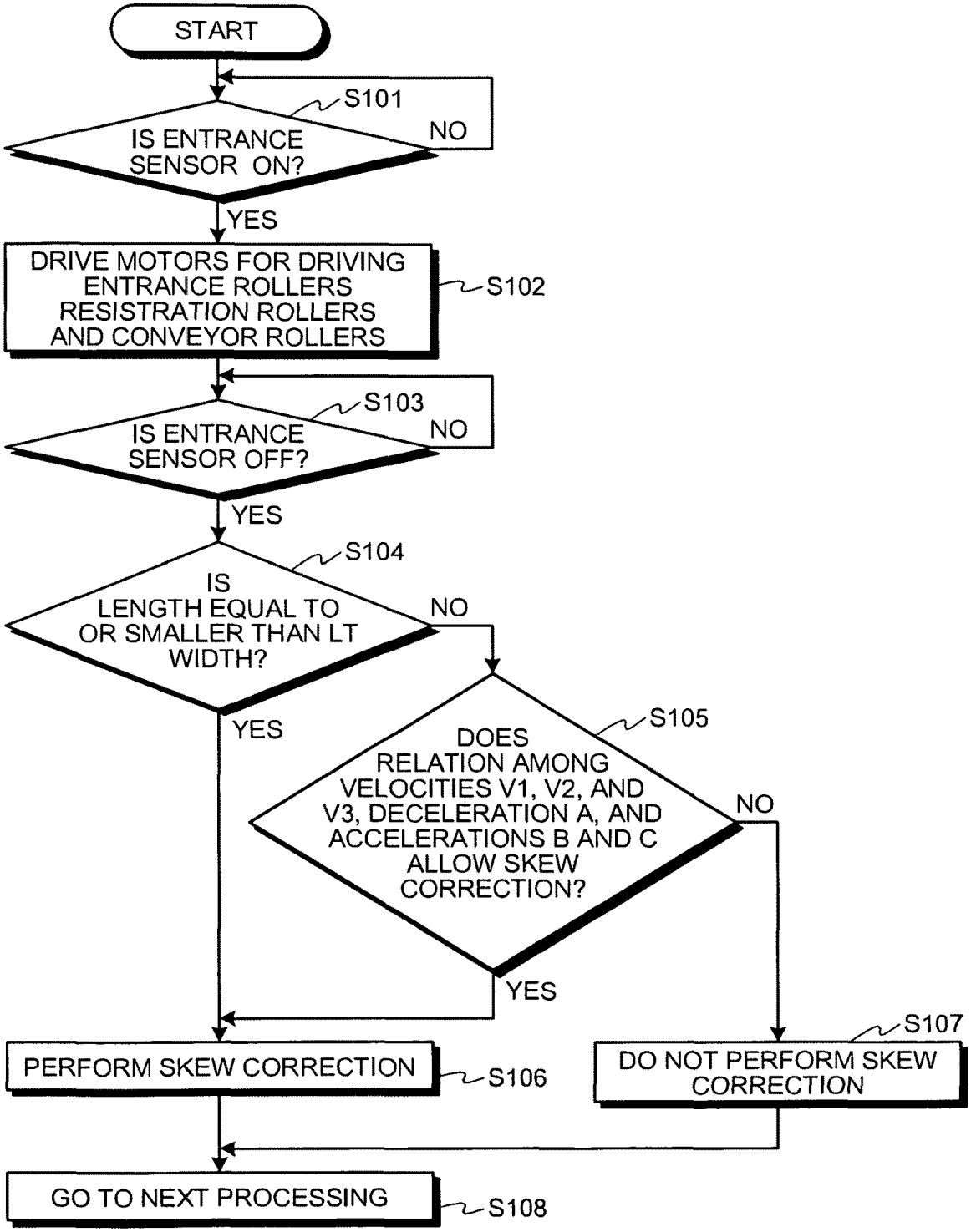
FIG. 4 is a flowchart of a control procedure for skew correction.
Figures 5A, 5B, 5C:
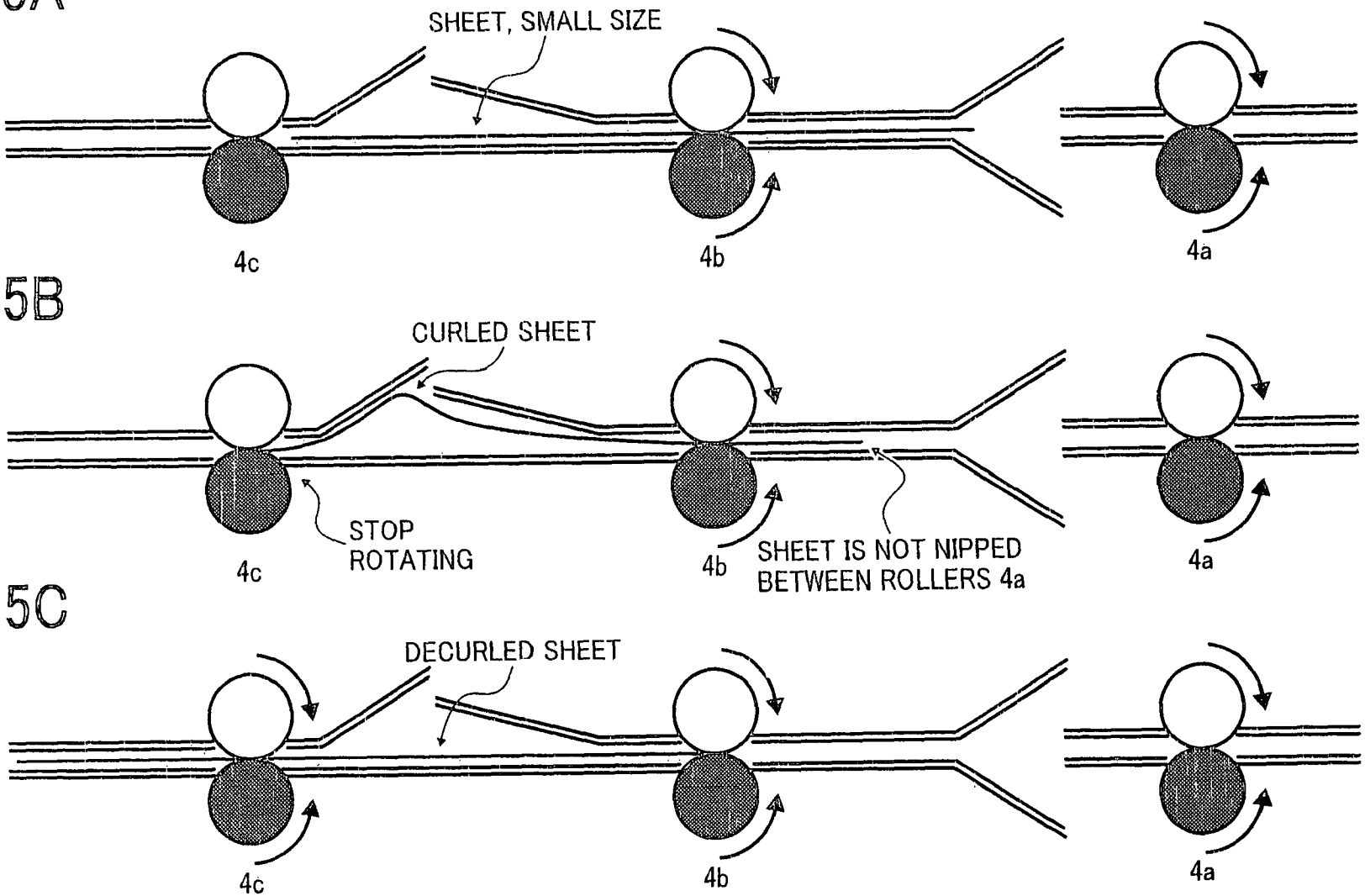
FIGS. 5A to 5C are schematic diagrams for explaining skew correction when a sheet abuts on the registration rollers while they stop.
Figure 6A:
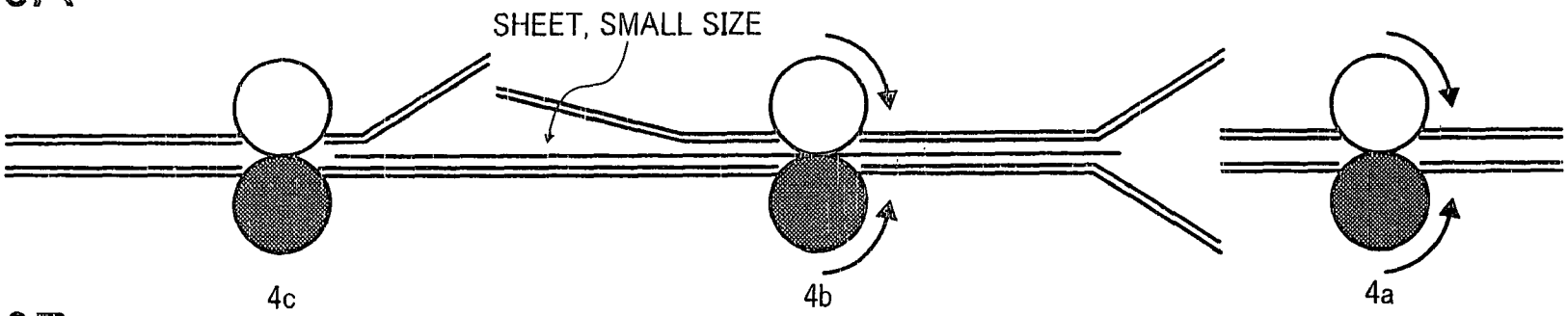
FIGS. 6A to 6C are schematic diagrams for explaining skew correction when a sheet abuts on the registration rollers while they are rotating in reverse.
Figure 6B:
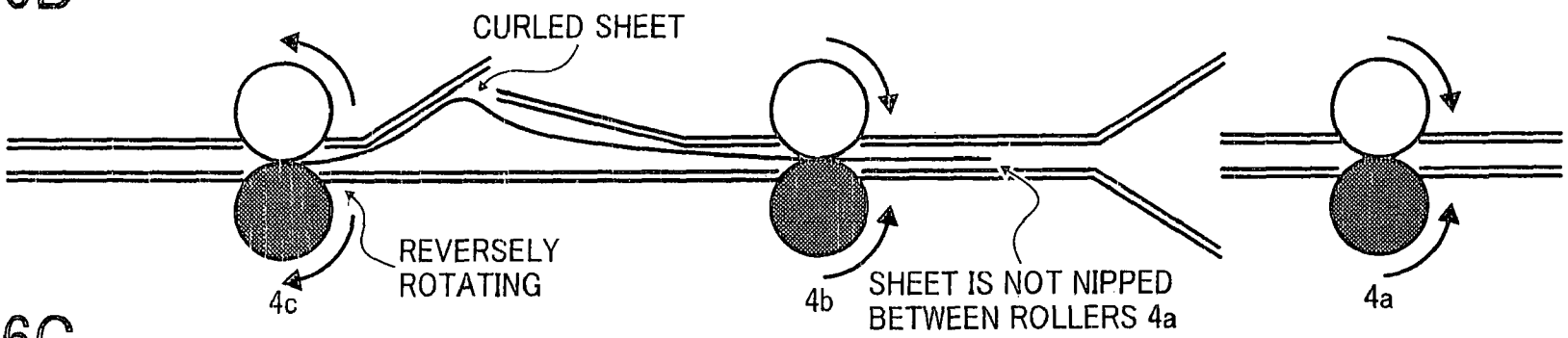
Figure 6C:
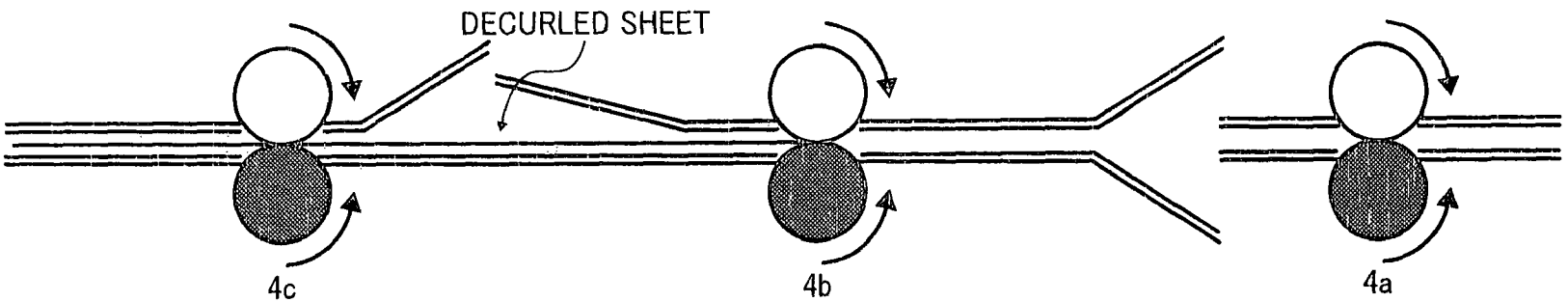

FIG. 3 is a timing chart of the operations of the entrance sensor S1 and the rollers 4*a*, 4*b*, and 4*c* upon correction of sheet posture, i.e., skew correction. FIG. 4 is a flowchart of a control procedure for the skew correction. FIGS. 5A to 7D are schematic diagrams for explaining details of the skew correction. In the following explanation, a sheet posture of which is corrected has a size equal to or smaller than letter size (LT) width, i.e., length of a letter-size (A4) sheet in the sheet-conveying direction when the sheet is printed in landscape orientation. When the posture of a sheet is corrected, the sheet once stops when abutting on the registration rollers 4*c*. At this time, if the sheet size is larger than the conveying distance d, the sheet is still nipped between the delivery rollers 4*a*. Therefore, the conveying distance d is set to a value equal to or slightly larger than the length of a LT-size sheet in the sheet-conveying direction, so that the posture of a sheet having a size equal to or smaller than LT width can be corrected. FIGS. 5A to 5C are schematic diagrams for explaining skew correction performed on a sheet abutting on the nip of the stopped registration rollers 4*c*, and depict the states of the sheet before, during and after skew correction, respectively. FIGS. 6A to 6C are schematic diagrams for explaining skew correction performed on a sheet abutting on the nip of the reversely-rotating registration rollers 4*c*, and depict the states of the sheet before, during and after skew correction, respectively.

When skew correction is performed on a sheet abutting on the nip of the stopped registration rollers 4*c*, as shown in FIG. 5A, the sheet is received by the entrance rollers 4*b* from the delivery rollers 4*a*, and is then transferred from the entrance rollers 4*b* to the registration rollers 4*c*. As shown in FIG. 5B, the leading edge of the sheet abuts on the nip of the registration rollers 4*c* in a stop state and thus its skew is corrected. At this time, because of the entrance rollers 4*b*, the sheet curls or becomes wavy at upstream of the registration rollers 4*c*. As shown in FIG. 5C, the sheet is forwarded with a high acceleration so that the velocity of the registration rollers 4*c* is equal to the velocity of the entrance rollers 4*b*. With this, the sheet is decurled and conveyed.

The operation shown in FIGS. 6A to 6C is similar to that shown in FIGS. 5A to 5C except that, in FIG. 6B, the registration rollers 4 rotate in reverse to wait for the sheet to abut.

The size of a sheet, posture of which is corrected, is explained below as being equal to or smaller than letter size (the conveying distance d is set to be equal to or smaller than LT width). The letter size can be "A4" size (210 by 297 millimeters), or is "A" size (8½ by 11 inches). Furthermore, a decrease of the conveying distance advantageously leads to downsizing of the finisher.

Specifically, as shown in FIG. 3, the delivery rollers 4*a* deliver a sheet from the image forming apparatus 1 to the sheet finisher 2. When the entrance sensor S1 is turned ON, the entrance rollers 4*b* start rotating. With the entrance rollers 4*b* rotating at a velocity V2, the sheet abuts on the registration rollers 4*c* at standstill or reversely rotating, with the entrance rollers 4*b* decelerating at a deceleration A. With the leading edge of the sheet abutting on the registration rollers 4*c*, the posture of the sheet is corrected. After completion of skew correction, the entrance rollers 4*b* accelerate with an acceleration B until its velocity reaches a velocity V2. On the other hand, the registration rollers 4*c* accelerate with an acceleration C until its velocity reaches a velocity V3.

At this time, the velocity and acceleration of the entrance roller 4*b* are different from those of the registration rollers 4*c* because control becomes easy by matching the velocity V2 of the entrance rollers 4*b* with the linear velocity of the leading edge of the next sheet. The relation is expressed as follows:

$$\text{acceleration C} \geqq \text{acceleration B}$$

$$\text{velocity V3} \geqq \text{velocity V2}$$

Figures 7A, 7B, 7C, 7D:
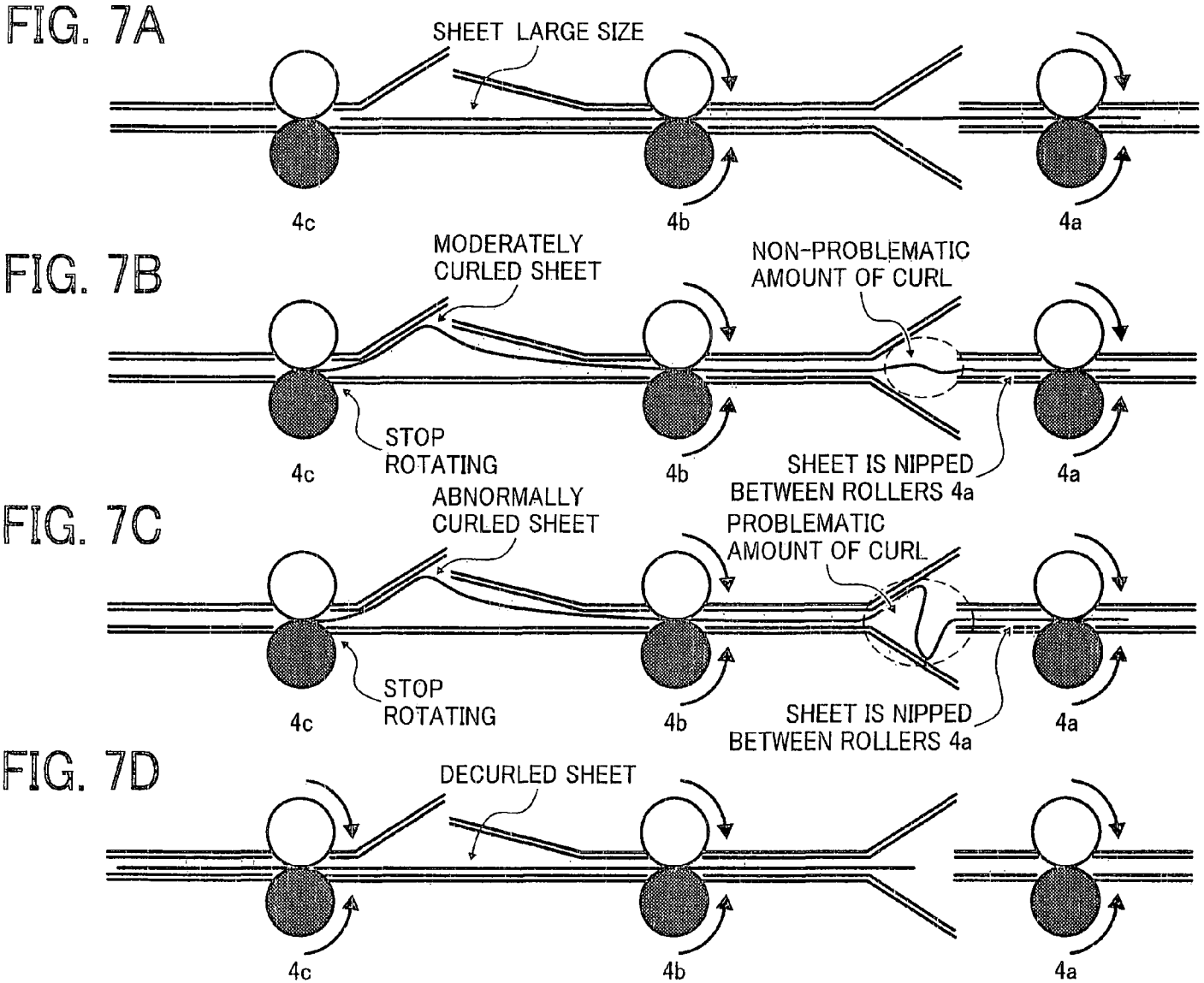
FIGS. 7A to 7D are schematic diagrams for explaining skew correction while a sheet is nipped between the delivery rollers.

If the size of a sheet is larger than LT width, it is possible to perform control such that the posture of the sheet is corrected if the amount of deformation (curl) formed on the sheet to be conveyed to the registration rollers 4*c* for skew correction does not affect conveyance of the sheet (FIG. 7B), while the posture of the sheet is not corrected if the amount of curl may cause an error (FIG. 7C). The curl in this context is the one formed between the entrance rollers 4*b* and the delivery rollers 4*a* of the image forming apparatus 1 because the entrance rollers 4*b* decelerate for skew correction while the delivery rollers 4*a* continues to be driven. FIG. 7A depicts a state where the sheet is conveyed by the delivery rollers 4*a* and the entrance rollers 4*b*. FIG. 7D depicts a state where the sheet is decurled and conveyed by the registration rollers 4*c*.

In FIG. 4, when the entrance sensor S1 is turned ON (step S101), the motor that drives the entrance rollers 4*b*, the motor that drives the registration rollers 4*c*, and the motor that drives the conveyor rollers 4*d* are respectively driven (step S102). When the entrance sensor S1 is turned OFF (step S103), it is checked whether the sheet length is equal to or smaller than LT width (step S104). If the sheet length is not equal to or smaller than LT width, it is checked whether a relation among the velocities V1, V2, and V3, the deceleration A, and the accelerations B and C allows skew correction (step S105). If the relation allows skew correction, skew correction is performed (step S106), and then the process control goes to the next process (step S108). If the relation does not allow skew correction, skew correction is not performed (step S107), and then the process control goes to the next process (step S108). In this case, since it is difficult to specify the amount of curl based on the thickness and strength of the sheet, the relation posing no problem is specified based on experiments or design. Examples of the problem include a folding mark on the sheet, a flaw on the sheet, and jamming.

For the skew correction as explained above, the sheet abuts on the registration rollers 4*c* at standstill in the example of FIG. 5B, while the sheet abuts on the registration rollers 4*c* rotating in reverse direction to the sheet-conveying direction in the example of FIG. 6B. This is because a skew tends to be easily corrected when a sheet abuts on reversely-rotating rollers. On the other hand, for the pursuit of high productivity, skew correction in a standstill state is preferred because reverse rotation of the registration rollers 4*c* causes a time loss.

At the time of skew correction, as evident from a timing chart of FIG. 3, to cause the sheet to abut on the registration rollers 4*c* at standstill (FIG. 5B), a predetermined time T1 is required by the time when deceleration of the entrance rollers 4*b* ends and the entrance rollers 4*b* stop. Similarly, to cause the sheet to abut on the reversely-rotating registration rollers 4*c* (FIG. 6B), a predetermined time T2 is required by the time when deceleration of the entrance rollers 4*b* and reverse rotation of the registration rollers 4*c* end to take a sufficient settling time.

The circumferential velocity V1 of the delivery rollers 4*a* and the circumferential velocity V2 of the entrance rollers 4*b* have a relation as follows.

For a sheet having a large size (with a dimension in the sheet-conveying direction larger than the conveying distance d), consider a case, for example, where it is allowable that deformation (curl) of up to 6 millimeters is formed between the entrance rollers 4*b* and the delivery rollers 4*a*. In this case, it is assumed that the velocity V2 of the entrance rollers 4*b* and the velocity V1 of the delivery rollers 4*a* are equal to each other. The entrance rollers 4*b* perform control such that 60 milliseconds are required by the time when the velocity is accelerated from 0 mm/s to 600 mm/s (control with the acceleration A). At this time, it is assumed that the sheet is delivered from the delivery rollers 4*a* at 600 mm/s (velocity V1). When the posture of the sheet is corrected, the sheet is decelerated by the entrance rollers 4*b* to abut on the registration rollers 4*c* (with the relation between the velocity V2 and the acceleration A). At this time, the delivery rollers 4*a* continues to be driven with the velocity V1. Therefore, the curl to be formed is roughly estimated as follows:

$$600\ \text{mm}/s \times 60\ \text{ms}/2 = 18\ \text{millimeters}$$

This amount of curl is too large. Therefore, skew correction is not performed.

Next, consider a case where control is performed such that 40 milliseconds are required by the time when the velocity is accelerated from 0 mm/s to 400 mm/s. In this case, when it is assumed that the sheet is delivered with 400 mm/s, the amount of curl formed between the entrance rollers 4*b* and the delivery rollers 4*a* is as follows:

$$400\ \text{mm}/s \times 40\ \text{ms}/2 = 8\ \text{millimeters}$$

This amount of curl is within a safe range. Therefore, in this example, the velocity V1 is required to satisfy the following condition:

$$V1 \leqq 400\ \text{mm}/s$$

As evident from the above, the velocity V1 is determined by the amount of curl formed between the entrance rollers 4*b* and the delivery rollers 4*a*. Upon determination of the velocity V1, the velocities V2 and V3, the acceleration A, and the decelerations B and C are simultaneously determined.

In this manner, the sheet with its skew corrected by the registration rollers 4*c* is guided to the lower conveying path 2*b* by rotating the branching nail 2*e* counterclockwise in FIG. 1. The operation on the lower conveying path 2*b* is explained below.

The sheet guided by the lower conveying path 2*b* rotates the switching nail 9 counterclockwise in the drawings with a moving force of the sheet, passes through the lower conveying path 2*c* ensured by the switching nail 9, and is then conveyed to the stapling tray 14 by the conveyor rollers 6, the conveyor rollers 7, and the stapling sheet delivery rollers 8. The conveyed sheet falls in a direction indicated by an arrow B under its self weight, and is tapped down by the tapping roller 14*a*. With this, the trailing edge of the sheet in the sheet-conveying direction is aligned by the second fence 11. Then, the trailing edge of the sheet is detected in advance by the sensor S2 and, after time for possible alignment in the sheet-conveying direction elapses, alignment in a width direction is made by the first fence 10. By repeating this operation, a plurality of sheets are aligned one by one.

Although the operation is as explained above in the case of one sheet, the operation in the case of two or more sheets is as follows.

The interval between output sheets from the image forming apparatus 1 is constant, and the interval between jobs is also constant. From the image forming apparatus 1, when the first sheet is output, signals indicative of the size of the sheets, the number of sheets, conveying velocity, process mode, and others are transmitted. With these signals received by the sheet finisher, the number of sheets to be stacked, an acceleration point, an accelerated linear velocity, a backflow point, a stop point at the time of stacking are determined.

Described below in reference to FIGS. 8A to 8D is an operation of conveying a sheet having a length in the sheet-conveying direction equal to or larger than B5 width (182 millimeters) and smaller than a legal (LG) size (355.6 millimeters). FIGS. 8A to 8D and 9A to 9D depict conveying states at downstream of the puncher 50 in the sheet-conveying direction.

Figure 8A:
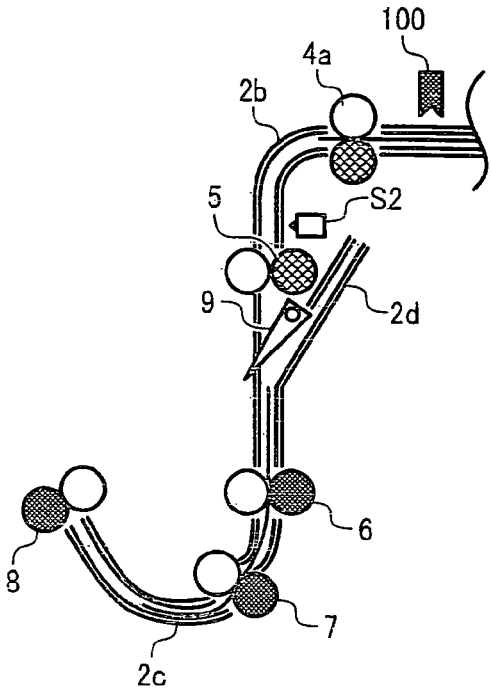
FIGS. 8A to 8D are schematic diagrams for explaining an operation of conveying a sheet with a length in a conveying direction larger than B5 size and smaller than legal size.

The head sheet of a job output from the image forming apparatus 1 is conveyed by the entrance rollers 4*b*, the registration rollers 4*c*, of the sheet finisher 2 the conveyor rollers 4*d*, and the conveyer rollers 5 to pass the branching nail 9 to a position shown in FIG. 8A (the sheet is conveyed as passing 5 millimeters away from the branching nail 9). AT this time, when backflow is required for the sheet based on a signal from the image forming apparatus 1, the conveyor rollers 6 and 7 once stop, and start reverse rotation in a clockwise direction. At this time, the branching nail 9 is activated to guide the sheet to the pre-stack path 2*d* for pre-stacking. A distance conveyed on this pre-stack path 2*d* is determined by a control timing with a pulse count from the sensor S2 disposed immediately before the conveyor rollers 5 or a timer, for example, and the sheet stops at a position where the leading edge of the sheet matches. At this time, the sheet is nipped between the conveyor rollers 6 and stops as protruding several millimeters from the nip. To minimize this amount of protrusion as much as possible, the sensor S2 is disposed at a position as near the point of reverse as possible, thereby reducing a conveying error and accurately stopping the sheet. With accurate stopping the amount of protrusion can be minimized, thereby reducing a shift at the time of conveying the sheet combined with the next sheet to improve alignment on the stapling tray 14.

Figure 8B:
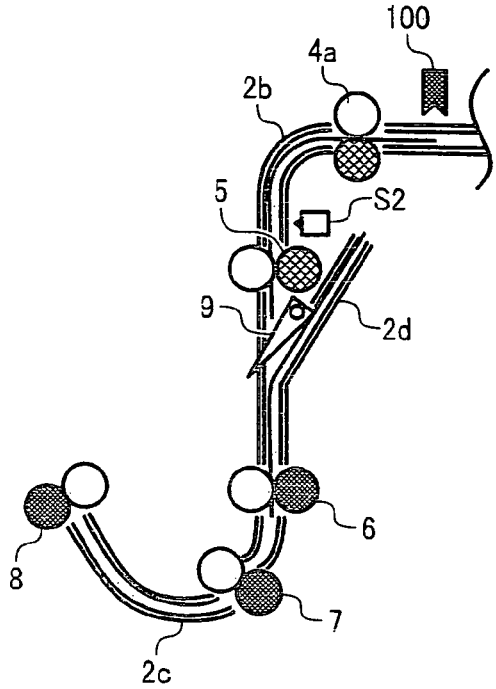
Figure 8C:
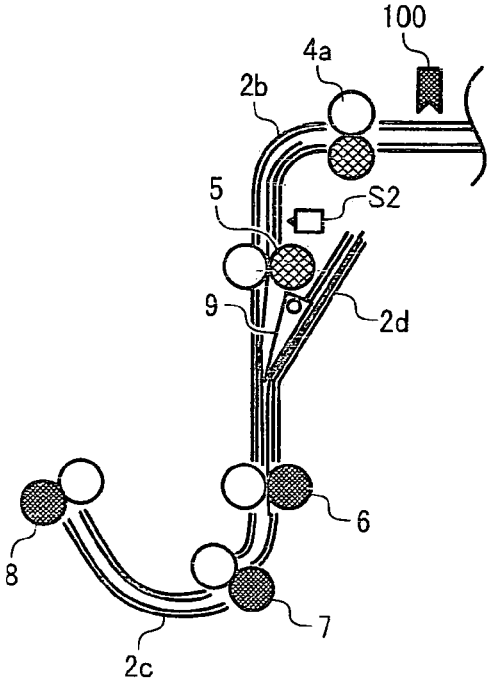
Figure 8D:
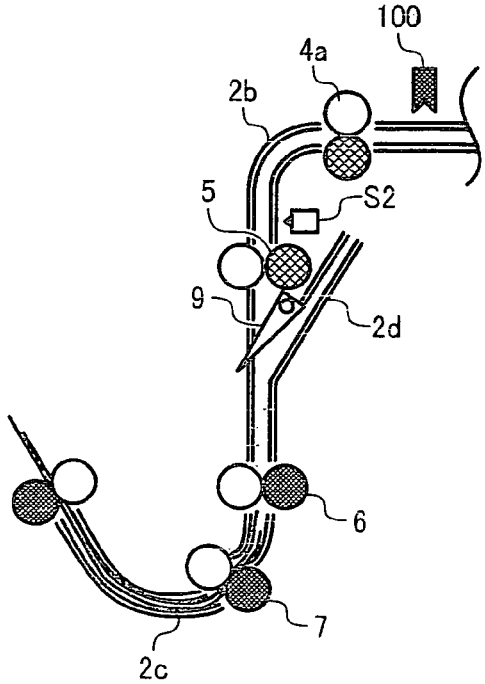
Figure 9A:
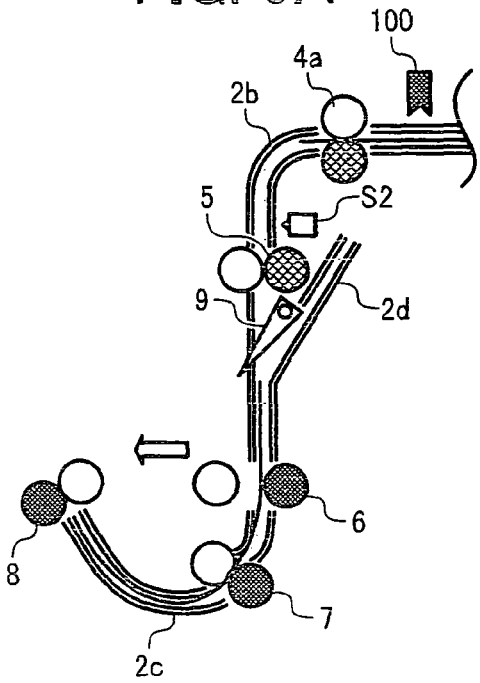
FIGS. 9A to 9D are schematic diagrams-for explaining an operation of conveying a sheet larger than A4 size.
Figure 9B:
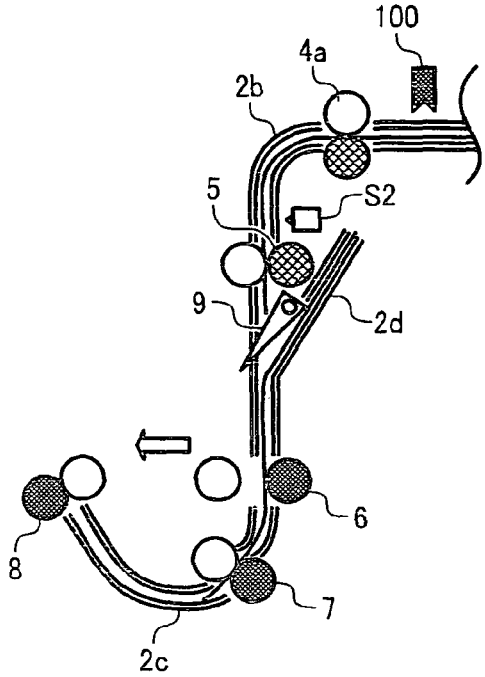
Figure 9C:
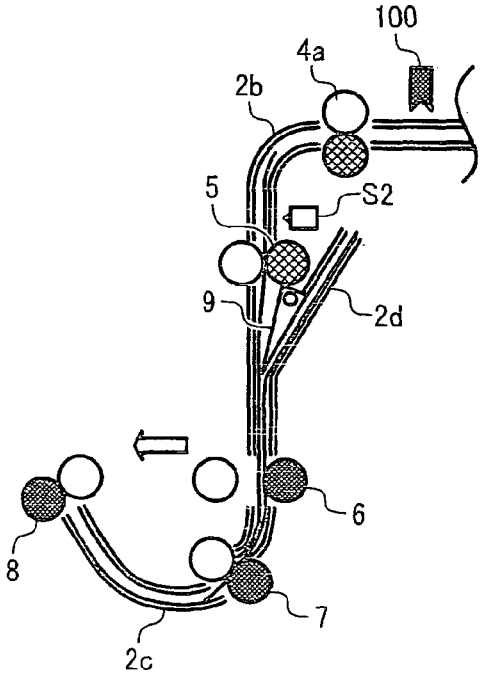
Figure 9D:
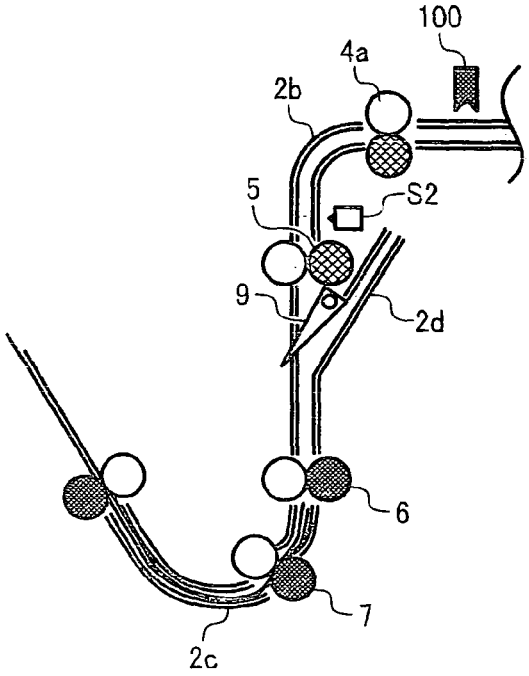

Next, as shown in FIG. 8B, the second sheet is conveyed by the conveyor rollers 5. When the leading edge of the second sheet is conveyed to a position a predetermined distance, for example, 5 millimeters, away from the conveyor rollers 5 on the upstream side, as shown in FIG. 8C, the sheets stacked on the second conveying path 2*c* are started to be conveyed by the conveyor rollers 6 and 7 rotating in a counterclockwise direction by detecting information from the sensor S2. As shown in FIG. 8D, the head sheet of the job is conveyed again as being nipped at the nip of the conveyor rollers 7. Therefore, with the leading edge of the head sheet of the job preceding the leading edge of the second sheet, these two sheets are simultaneously delivered onto the stapling tray 14. For the bundle of delivered sheets, the discharge belt 13 rotates, which is placed in parallel to the sheet-conveying direction at a center portion of the stapling tray 14, a pair of discharge nails 13*a* and 13*b* placed at positions symmetrical to each other with respect to the discharge belt 13 move in the direction indicated by the arrow B so that one of the discharge nails 13*a* and 13*b* taps, with its back, the leading edge of the sheet to fall the sheet to the second fence 11 to align the shift in the sheet-conveying direction. With this, post processing can be performed without decreasing productivity and binding quality of the apparatus. The discharge belt 13 is stretched over between the discharge roller 19 and the driven roller 19*a* to perform a sheet discharging operation.

This is a conveying state in the case of two sheets. Depending on the process at the stapling tray 14, two, three, or more sheets are stacked. Between jobs, the operation explained above is repeated, thereby performing post processing without reducing cards per minute (CPM) of the apparatus.

In the first embodiment, the timing of re-conveying a sheet that has waited on the pre-stack path 2*d* is set so that the sheet is set at a position 5 millimeters from the conveyor rollers 6 on the upstream side. However, the sheet is not necessarily set at the position 5 millimeters from the conveyor rollers 6. On a condition that the leading edge of an N+1-th sheet does not enter a gap between the conveyor rollers 6 during the slow-up of the conveyor rollers 6, the sheet is set at a position as near the conveyor rollers 6 as possible. Even if the leading edge of the N+1-th sheet abuts on the conveyor rollers 6 and then the sheet is conveyed, this does not pose no problem as long as a leading edge flaw, a flaw caused by curl or the like does not occur.

Described below in reference to FIGS. 9A to 9D is an operation of conveying a sheet larger than an A4 length (equal to or larger than B4 length or LG size). When a sheet equal to or larger than B4 length or LG size is conveyed, one of the conveyor rollers 6 is operated in advance in an arrow direction to release pressure. Since the distance between the conveyor rollers 5 and the conveyor rollers 7 is set several millimeters to 10 millimeters shorter than the LG size, the sheet can be conveyed without any problem even if the pressure of the conveyor rollers 6 is released.

With this state, the conveyor rollers 7 perform the operation of the conveyor rollers 6 as explained above for pre-stacking.

If the pressure of the conveyor rollers 6 is not released when sheets equal to or larger than the B4 width and the LG size are pre-stacked, as is the case of sheets smaller than the LG size, the sheets have to be reversely conveyed to a position 5 millimeters from the conveyor rollers 6 on the upstream side and stopped. That is, as the sheets are longer, the reverse conveying distance is longer, thereby making it impossible for the next sheet to enter a gap between the conveyor rollers 6. This cannot address high productivity.

In the example of FIGS. 9A to 9D, the pressure of the conveyor rollers 6 is released by moving the driven roller in the arrow direction. Alternatively, the driving roller may be moved to release the pressure. FIGS. 10, 11, 12A, and 12B depict a pressure releasing mechanism of the driving roller.

Figure 10:
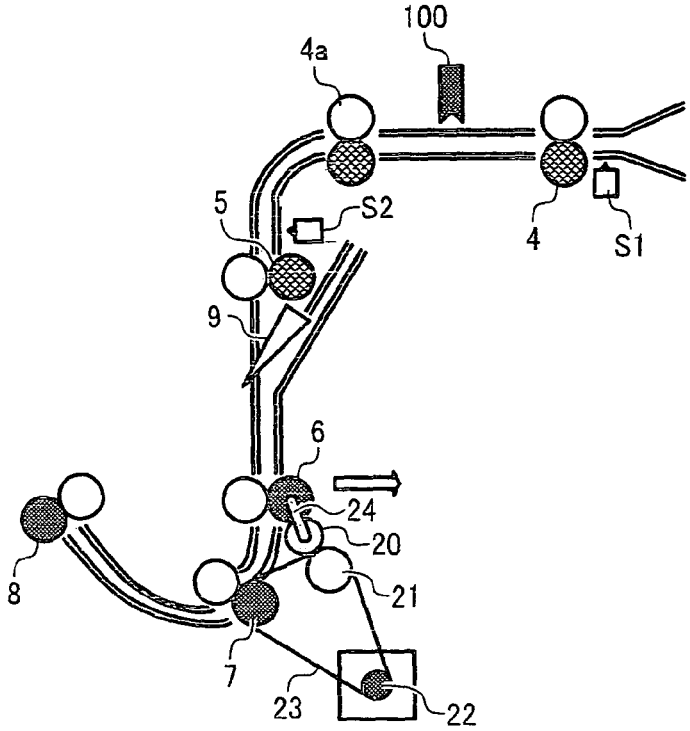
FIG. 10 is a schematic diagram of a driving mechanism of two conveyor rollers at downstream of a switching nail shown in FIG. 1.
Figure 11:
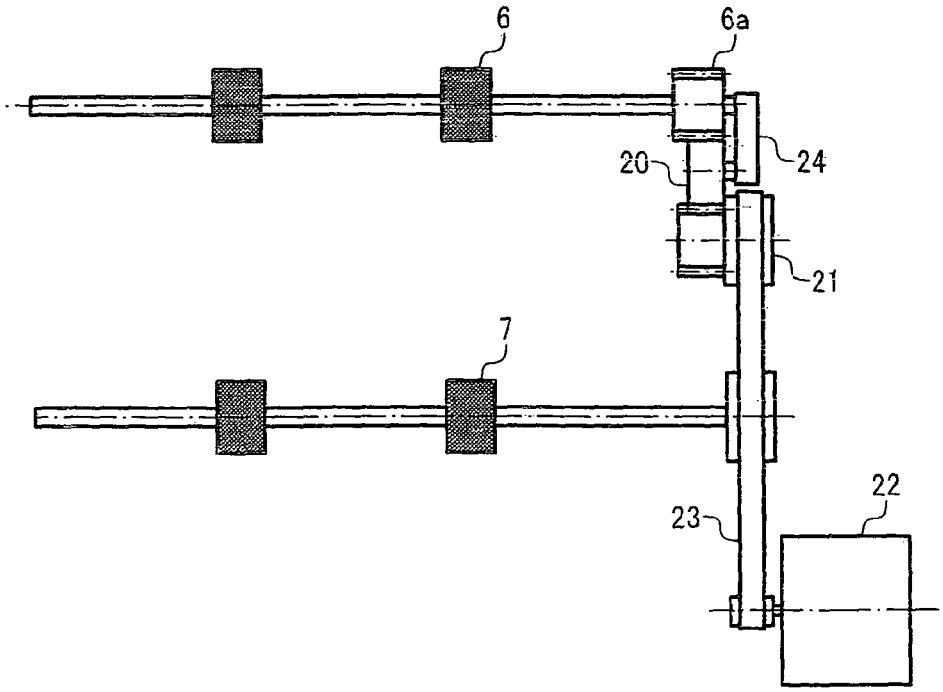
FIG. 11 is a side view of the driving mechanism shown in FIG. 10.

FIGS. 10 and 11 are schematic diagrams of the driving mechanism of the conveyor rollers 6 and 7. As shown in FIGS. 10 and 11, the conveyor rollers 6 transfer a driving force from a motor 22 to a pulley 21 via a belt 23, and further rotate via an idler 24. The idler 24 and a gear 6*a* are connected via a link 20. When the conveyor roller 6 is moved in an arrow direction in FIG. 10, the gear 6*a* rotates about the idler 24. At this time, since the link 20 is connected to the idler 24 and the gear 6*a*, an inter-shaft distance therebetween is not changed.

Figure 12A:
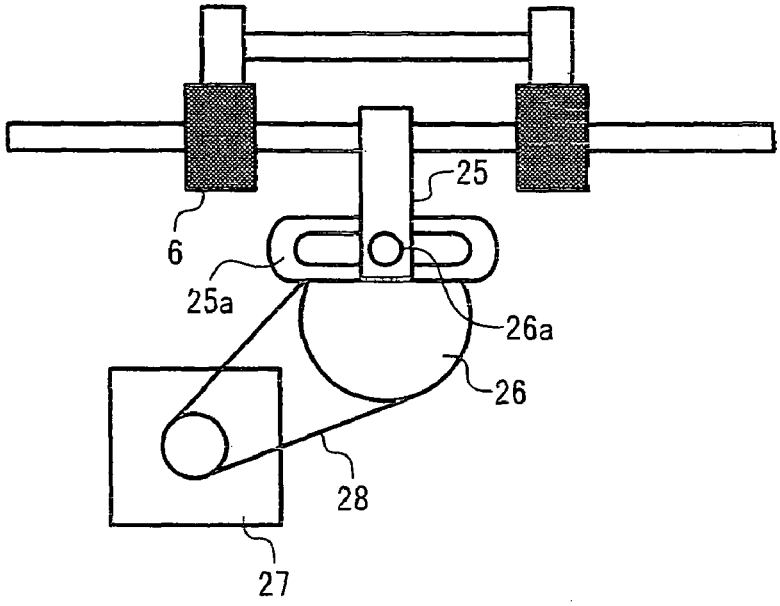
FIGS. 12A and 12B are schematic diagrams of a contacting/separating mechanism for a conveyor roller on the upstream side in a sheet-conveying direction shown in FIG. 10.
Figure 12B:
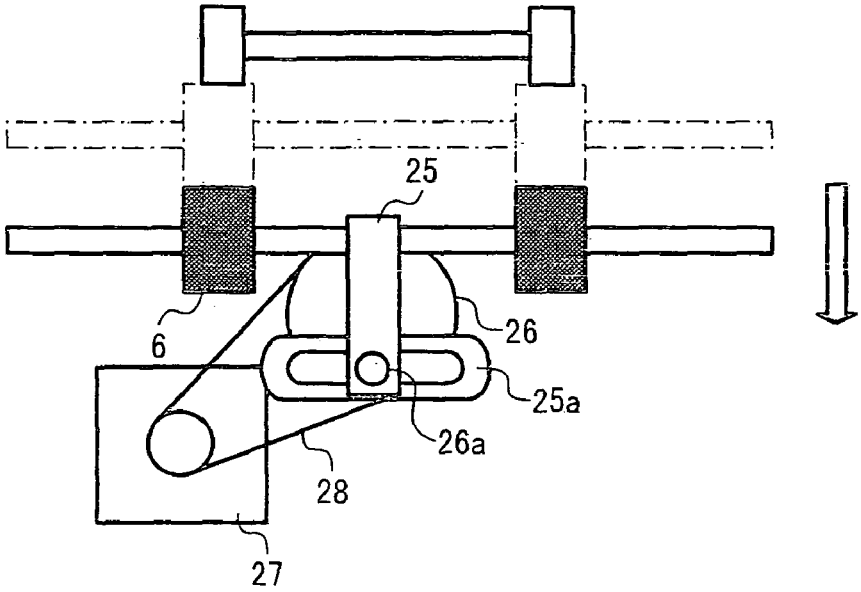

FIGS. 12A and 12B are schematic diagrams of a moving (contacting/separating) mechanism for the conveyor roller 6 in an arrow direction. As shown in FIGS. 12A and 12B, a lever 25 is connected to the shaft of the conveyor roller 6. The lever 25 has a sliding portion 25*a* over a long hole, in which a pin unit 26*a* of a pulley 26 is inserted. The pulley 26 rotates in a clockwise direction (or counterclockwise direction) when a force is transmitted from the motor 27 via a belt 28. Accordingly, the pin unit 26*a* slides over the sliding portion 25*a* over the long hole so that a transition is made from the state in FIG. 12A to the state in FIG. 12B, that is, from the state where a pressure is exerted to the state where the pressure is released.

With the operation as explained above, sheets equal to or larger than the LG size can be pre-stacked.

Figure 13:
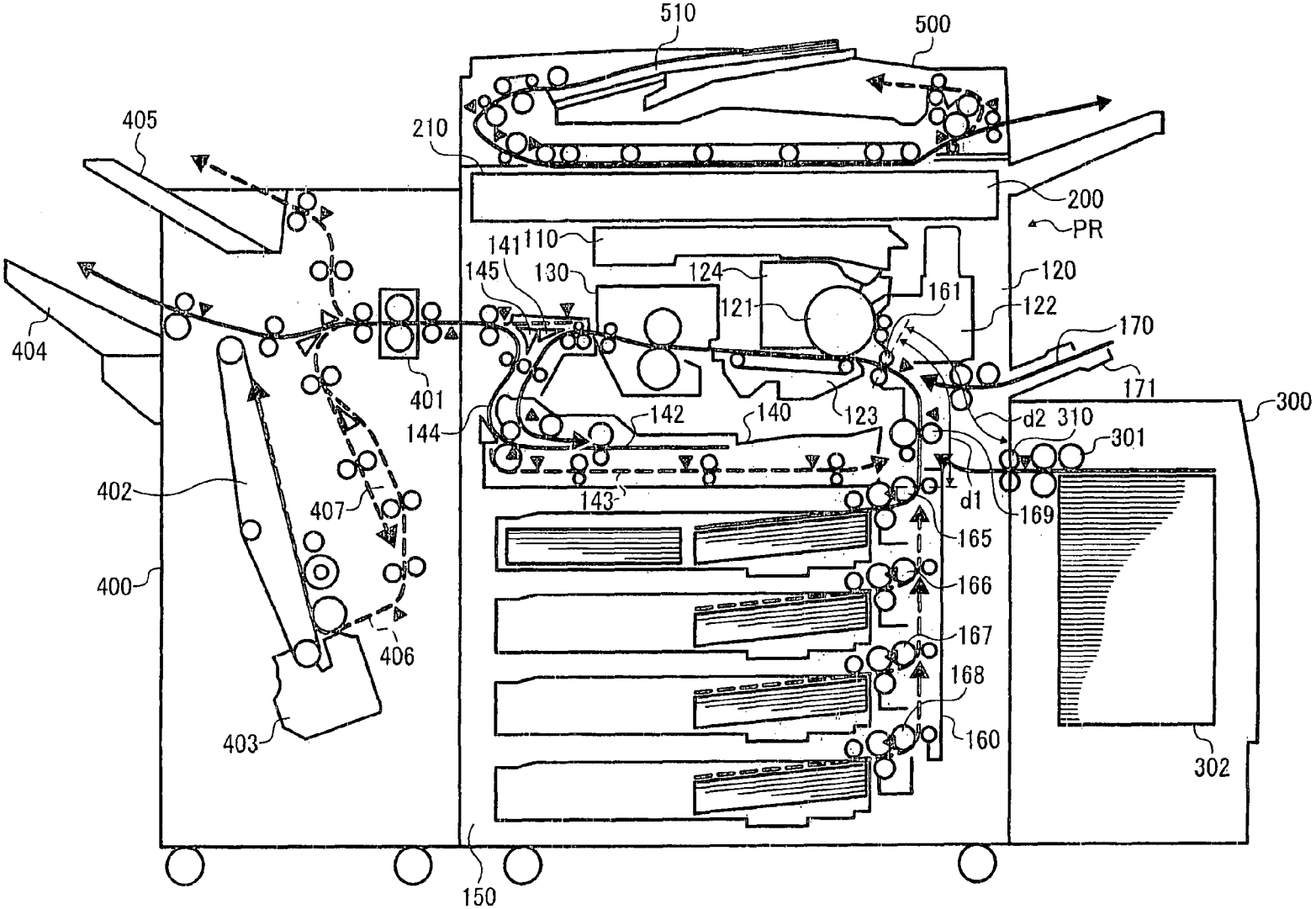
FIG. 13 is a schematic diagram of an image forming system including a sheet finisher, an image forming apparatus, and a sheet feeding device according to a second embodiment of the present invention.

FIG. 13 is a schematic diagram of an image forming system according to a second embodiment of the present invention. The image forming system including a sheet finisher, an image forming apparatus, and a sheet feeding device. The image forming apparatus is explained below as, for example, a digital copier. The digital copier is for forming a monochrome image, and includes a body PR, an image reading apparatus 200 set on an upper portion of the image forming apparatus body PR, and an automatic document feeder (ADF) 500 attached further thereon, a large-capacity sheet feeding device 300 disposed on the right side, and a sheet finisher 400 disposed on the left side of the image forming apparatus body PR in FIG. 13.

The image forming apparatus body PR includes an image writing unit 110, an image forming unit 120, a fixing unit 130, a duplex conveying unit 140, a sheet feeding unit 150, a vertical conveying unit 160, and a manual sheet feeding unit 170.

The image writing unit 110 modulates a laser diode (LD), which is a light-emitting source, based on image information of a document read by the image reading apparatus 200, and performs laser writing onto a photosensitive drum 121 with a scanning optical system, such as a polygon mirror and an fθ lens. The image forming unit 120 includes known electrophotographic image-forming components, such as the photosensitive drum 121, a developing unit 122 provided along an outer perimeter of this photosensitive drum 121, a transferring unit 123, a cleaning unit 124, and a static eliminating unit.

The fixing unit 130 fixes an image transferred by the transferring unit 123 onto the sheet by heat and pressure. The duplex conveying unit 140 is provided at downstream of the fixing unit 120 in a sheet-conveying direction, includes a first switching nail 141 that switches the sheet-conveying direction between the sheet finisher 400 side and the duplex conveying unit 140 side, a reverse conveying path 142 for conveying the sheet guided by the first switching nail 141 to the duplex conveying unit 140 side, an image-formation-side conveying path 143 for conveying the sheet reversed on the reverse conveying path 142 to the transferring unit 123 side again, and a post-processing-side conveying path 144 for conveying the reversed sheet to the sheet finisher 400 side. At a branching portion between the image-formation-side conveying path 143 and the post-processing-side conveying path 144, a second switching nail 145 is disposed.

The sheet feeding unit 150 includes four sheet feeding stages. A sheet accommodated in a sheet feeding stage selected by a pickup roller and a sheet feeding roller is drawn to be guided to the vertical conveying unit 160. The vertical conveying unit 160 conveys the sheet fed from the relevant one of the sheet feeding stages via relevant one of a pair of conveyor rollers 165, 166, 167, 168, and 169 to registration rollers 161 immediately before (upstream of) the transferring unit 123 in the sheet-conveying direction. The registration rollers 161 sends the sheet to the transferring unit 123 in timing with the leading edge of the visualized image on the photosensitive drum 121. The manual sheet feeding unit 170 includes a manual feeding tray 171 that can freely open and close. The manual feeding tray 171 is opened as required to supply a sheet by manual feeding. Also in this case, a sheet conveying timing is taken by the registration rollers 161 for conveyance.

The large-capacity sheet feeding device 300 stacks a large amount of sheets of the same size for supply. As the sheets are consumed, a bottom plate 302 moves upward, thereby allowing a sheet to be always picked up from a pickup roller 301. The sheet fed from the pickup roller 301 is conveyed by a pair of conveyor rollers 310 from the vertical conveying unit 160 via the conveyor rollers 169 to a nip of the registration rollers 161.

The sheet finisher 400 performs a predetermined process, such as punching, alignment, stapling, and sorting, and corresponds to the sheet finisher 2 in the first embodiment. In the second embodiment, for the functions, a puncher 401, a stapling tray (for alignment) 402, a stapler 403, and a shift tray 404 are provided. That is, the sheets conveyed from the image forming apparatus PR to the sheet finisher 400 are punched one by one by the puncher 401 when punching is performed, and are then transferred to a proof tray 405 when no particular process is performed. When sorting or stacking is performed, the sheets are delivered to the shift tray 404. In the second embodiment, sorting is performed by the shift tray 404 moving in a reciprocating manner by a predetermined amount in a direction perpendicular to the sheet-conveying direction. In addition, sorting can be performed by moving the sheet on any sheet conveying path in a direction perpendicular to the sheet-conveying direction.

For alignment, a punched sheet or an-un-punched sheet is guided to a lower conveying path 406, and is aligned in a direction perpendicular to the sheet-conveying direction by a second fence on the stapling tray 402 and also in a direction parallel to the sheet-conveying direction by a jogger fence. When binding is performed, a bundle of aligned sheets is bound by the stapler 403 at a predetermined position on the bundle of sheets, for example, a corner or two center positions, and is then delivered by a discharge belt to the shift tray 404. The lower conveying path 406 is provided with a prestack conveying path 407, on which a plurality of sheets are stacked at the time of conveyance, thereby avoiding an interruption of the image forming operation on the image forming apparatus body PR side during post-processing.

The image reading apparatus 200 optically scans a document guided by the ADF 500 onto a contact glass 210 and then stopped, and reads, with an opti-electric converting element, such as a charge-coupled device (CCD) or a complementary metal oxide semiconductor (CMOS), a read image formed by an image forming lens via first to third mirrors. The read image data is subjected to a predetermined image process by an image processing circuit (not shown), and is then-temporarily stored in a storage device. Then, at the time of image formation, the image data is read from the storage device by the image writing unit 110, modulated according to an image data, and is optically written.

The ADF 500 has a duplex reading function, and is mounted on a set surface of the contact glass 210 of the image reading apparatus 200 to be freely opened and closed. This ADF 500 automatically feeds a document placed on a document table 510 onto the contact glass 210 at the time of reading the document.

In the second embodiment, a conveying distance dl from the conveyor rollers 165 of the uppermost sheet feeding stage of the vertical conveying unit 160 of the sheet feeding unit 150 to the registration rollers 161 and a conveying distance d2 from the conveyor rollers 310 of the large-capacity sheet feeding device 300 to the registration roller 161 are both set to be equal to or larger than the maximum size of the sheet posture of which is to be corrected by the registration rollers 161.

Portions not particularly explained are of basically the same configuration and operate in the same manner as those previously described in the first embodiment. The conveying distances d, d1, and d2 are required to be at least equal to or larger than the maximum length in the sheet-conveying direction of the sheet posture of which is to be corrected. However, in consideration of downsizing, each distance is preferably as short as possible although it is equal to or longer than the maximum length.

As explained above, according to an embodiment of the present invention, the posture of a sheet equal to or smaller than letter size width can be accurately corrected. If the sheet size is restricted, conveying distance can be reduced, which facilitates downsizing of a sheet finisher.

The rotational velocity of delivery rollers of an image forming apparatus, that of entrance rollers of the sheet finisher, that of registration rollers for skew correction, and accelerations (and decelerations) of the respective rollers are controlled as being compared with each other to determine whether to correct the posture of a sheet. Thus, sheets with a larger length (not restricted in size) can also be processed. This enables a versatile system. That is, with a low-speed or intermediate-speed image forming apparatus, even the posture of a sheet having a size larger than letter size width can be corrected.

Moreover, this system is resistant to jamming irrespectively of the sheet size. Thus, stable conveyance quality can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device comprising:

a correcting unit in a sheet finisher that corrects skew of a sheet;

a conveying unit in the sheet finisher that conveys the sheet delivered from a delivering unit located in an image forming apparatus to the conveying unit; and a conveying path having a length equal to or longer than a distance between the delivering unit and the correcting unit for skew correction of a sheet in a conveying direction in which the sheet is conveyed, wherein the correcting unit does not correct skew of the sheet when the sheet is longer than the conveying path, and when an amount of deformation of the sheet formed on a path from the delivering unit to the conveying unit exceeds a predetermined value.

2. The sheet conveying device according to claim 1, wherein the conveying path is 297 millimeters.

3. The sheet conveying device according to claim 1, further comprising a controlling unit configured to control velocity, stop timing, and acceleration of the delivering unit, the conveying unit, and the correcting unit when the sheet is longer than the conveying path, so that an amount of deformation of a sheet on the conveying path does not exceed a predetermined value to enable skew correction.

4. The sheet conveying device according to claim 3, wherein the controlling unit controls linear velocity of the delivering unit, the conveying unit, and the correcting unit such that the delivering unit conveys the sheet at a first velocity, and the conveying unit conveys the sheet at a second velocity, the conveying unit decelerates when a leading edge of the sheet passes the conveying unit, the correcting unit stops rotating or rotates reversely, the conveying unit accelerates to the second velocity after a predetermined time has elapsed, and the correcting unit accelerates to a third velocity.

5. The sheet conveying device according to claim 4, wherein the first velocity is determined based on the amount of deformation formed on the path from the delivering unit to the conveying unit.

6. A sheet feeding device comprising:

the sheet conveying device according to claim 1; and a sheet feeding unit that is located at upstream of the sheet conveying device in the conveying direction.

7. A sheet finisher comprising:

the sheet conveying device according to claim 1; and a punching unit that is located at downstream of the correcting unit in the conveying direction, the punching unit being configured to punch a sheet.

8. A sheet finisher comprising:

the sheet conveying device according to claim 1; and a binding unit that is located at downstream of the correcting unit in the conveying direction, the binding unit being configured to bind a plurality of sheets.

9. An image forming apparatus comprising the sheet conveying device according to claim 1.

10. An image forming apparatus comprising the sheet feeding device according to claim 6.

11. An image forming apparatus comprising the sheet finisher according to claim 7.

12. An image forming apparatus comprising the sheet finisher according to claim 8.

13. A sheet conveying method applied to a sheet conveying device including a correcting unit that corrects skew of a sheet and a conveying unit that conveys the sheet delivered from a delivering unit to the conveying unit, the method comprising:

setting a conveying path length to be equal to or longer than a distance between the correcting unit and the delivering unit for skew correction in a conveying direction in which the sheet is conveyed;

determining if the sheet is longer than the conveying path;

correcting skew of the sheet by causing the sheet to abut on the correcting unit that stops rotating or is rotating reversely;

correcting a leading edge position of the sheet which is deformed while abutting on the correcting unit; and allowing the sheet to pass through the correcting unit.

14. The sheet conveying method according to claim 13, further comprising controlling, when the sheet is longer than the conveying path, velocity, stop timing, and acceleration of the delivering unit, the conveying unit, and the correcting unit so that an amount of deformation of the sheet formed on a path from the delivering unit to the conveying unit does not exceed a predetermined value to enable skew correction.

15. The sheet conveying method according to claim 14, wherein the controlling includes controlling linear velocity of the delivering unit, the conveying unit, and the correcting unit such that the delivering unit conveys the sheet at a first velocity, and the conveying unit conveys the sheet at a second velocity, the conveying unit decelerates when a leading edge of the sheet passes the conveying unit, the correcting unit stops rotating or rotates reversely, the conveying unit accelerates to the second velocity after a predetermined time has elapsed, and the correcting unit accelerates to a third velocity.

16. The sheet conveying device according to claim 1, wherein the sheet finisher and the image forming apparatus are independent devices.

17. The sheet conveying device according to claim 3, wherein the amount of deformation is 6 millimeters or less.

* * * * *